US012016514B1

(12) United States Patent
Smith

(10) Patent No.: US 12,016,514 B1
(45) Date of Patent: Jun. 25, 2024

(54) VACUUM CLEANER HEAD

(71) Applicant: Marc Smith, Thousand Oaks, CA (US)

(72) Inventor: Marc Smith, Thousand Oaks, CA (US)

( * ) Notice: Subject to any disclaimer, the term of this patent is extended or adjusted under 35 U.S.C. 154(b) by 0 days.

(21) Appl. No.: 17/962,501

(22) Filed: Nov. 10, 2022

(51) Int. Cl.
*A47L 9/06* (2006.01)
*A47L 9/24* (2006.01)

(52) U.S. Cl.
CPC ..... *A47L 9/0693* (2013.01); *A47L 9/242* (2013.01); *A47L 9/248* (2013.01)

(58) Field of Classification Search
CPC . A47L 5/36; A47L 9/02; A47L 9/0693; A47L 9/242; A47L 9/248
USPC ..... 15/414, 415.1, 418, 378, 395, 415
See application file for complete search history.

(56) References Cited

U.S. PATENT DOCUMENTS 1,053,665 A * 2/1913 Spencer ..... A47L 9/02 415/212.1
2,101,222 A * 12/1937 Leonard ..... A47L 9/06 15/398
2,643,413 A * 6/1953 Nicholas ..... A47L 9/0693 15/210.1
2,805,440 A * 9/1957 Hakanson ..... A47L 9/06 15/415.1
2,885,715 A * 5/1959 Anderson ..... A47L 9/02 15/418
3,780,398 A * 12/1973 Candor ..... A47L 9/02 15/420
4,332,051 A * 6/1982 LaMonte ..... A47L 9/0613 15/328
4,694,529 A * 9/1987 Choiniere ..... A47L 9/02 15/420

(Continued)

FOREIGN PATENT DOCUMENTS

CN 107669211 A * 2/2018 ..... A47L 9/0693
JP 2006068048 A * 3/2006
KR 102222204 B1 * 3/2021

OTHER PUBLICATIONS

CN-107669211-A Espacenet translation (Year: 2023).*
JP-2006068048-A Espacenet translation (Year: 2023).*
KR-102222204-B1 Espacenet translation (Year: 2023).*

*Primary Examiner* — Brian D Keller
*Assistant Examiner* — Tim Brady
(74) *Attorney, Agent, or Firm* — Ralph D. Chabot

(57) ABSTRACT

A vacuum cleaner head with a suction component consisting of laterally-opposed wing-like members positioned transversely to the front end of the head used to access and suction dirt, debris and fluids within confined or low-clearance areas under furniture and appliances and includes a generally thin flat elongated hollow member designed to reach maximum extension and floor surface coverage within the confined or low-clearance areas. Included is a flexible hollow hose fitting set back and disposed at an acute angle from the back end of the vacuum cleaner head for slidably mounting the vacuum cleaner head to a hollow hose wand. The hollow hose wand with a bottom end releasably attached to the flexible hollow hose fitting is adapted to be bent downward toward the floor surface when a sufficient downward pressure is exerted by the user upon the hollow hose wand used for maneuvering (approximately eleven inches in width) the vacuum cleaner head. This action also ensures that the head continues in constant sliding engagement with the floor to prevent the head from separating or lifting off from the floor surface and neutralizing the otherwise full functional capability of the suction head.

7 Claims, 12 Drawing Sheets

(56) References Cited

U.S. PATENT DOCUMENTS 4,715,088 A * 12/1987 Haase ..... A47L 9/02 15/422.1
5,533,230 A * 7/1996 Rouda ..... A47L 9/02 15/420
5,535,478 A * 7/1996 Thompson ..... A47L 9/02 15/419
6,430,773 B1 * 8/2002 Buron ..... A47L 9/02 15/374
7,370,390 B1 * 5/2008 Muller ..... A47L 9/02 15/415.1
2002/0148072 A1 * 10/2002 Kent ..... A47L 7/0009 15/415.1
2004/0020007 A1 * 2/2004 Lausevic ..... A47L 9/0613 15/420
2004/0221419 A1 * 11/2004 Francoeur ..... A47L 9/0613 15/393
2012/0090639 A1 * 4/2012 Heldman ..... A47L 9/02 15/246.2
2013/0326843 A1 * 12/2013 Schwartz ..... A47L 9/02 15/415.1
2015/0128998 A1 * 5/2015 Nemedi ..... B08B 5/04 134/21
2015/0223656 A1 * 8/2015 Tucker ..... A47L 9/0606 15/415.1
2015/0320275 A1 * 11/2015 Borges ..... A47L 9/0693 134/21
2017/0007086 A1 * 1/2017 Kleine-Doepke ..... A47L 9/0606
2018/0000299 A1 * 1/2018 Caldwell ..... A47L 9/242
2019/0021563 A1 * 1/2019 Asahi ..... A47L 9/0693
2019/0059669 A1 * 2/2019 Westbrook ..... A47L 9/0693
2019/0159641 A1 * 5/2019 Geurden ..... A47L 9/0673
2021/0177224 A1 * 6/2021 Towberman ..... F28G 1/166
2022/0167812 A1 * 6/2022 Droguett Larrain .. A47L 9/0606
2022/0192448 A1 * 6/2022 Kronenberger ..... F04D 29/703

* cited by examiner

VACUUM CLEANER HEAD

BACKGROUND OF THE INVENTION

Field of the Invention

The invention relates generally to the field of floor vacuum cleaner appliances and, more particularly, to an improved vacuum cleaner head used to access and suction dirt, assorted debris or water or other fluids off a floor surface within confined or low-clearance areas under furniture and appliances of all kinds.

Description of the Prior Art

Floor vacuum cleaners are well known in the prior art, including, for example, upright, stick, handheld and cannister models. Examples of these are shown in U.S. Pat. Nos. 1,658,311; 6,237,188B1; 7,669,281B2; 846,868 B2; U.S. Pub. Pat. App. No. 2008/0222839 A1; (PCT) Intl. Pub. App. No. WO2005 084511 A1; U.S. Pub. Pat. App. No. 2018/0192835 A1; and U.S. Pub. Pat. App. No. 2009/10031522 A1.

In all instances, vacuum cleaner appliances, notwithstanding the model type, include some version of a vacuum cleaner head, standard or modified, used to access and clean floor surfaces located in difficult to reach areas, such as, for example, areas beneath, behind and alongside items of furniture, appliances and the like. However, because of certain design and structural limitations, prior art vacuum cleaner heads are unable to effectively and efficiently access and clean these areas of low clearance. Such limitations include, for example, those associated with the vacuum cleaner heads shown in U.S. Des. Pat. No. 542,990 S, U.S. Des. Pat. No. 815,380 S, U.S. patent Ser. No. 10/117,554 B2, U.S. Pub. Pat. App. No. 2008/0222839 A1, U.S. Pub. Pat. No. 2010/0206336 A1, U.S. Pub. Pat. No. 2004/0194251 A1, U.S. Pub. Pat. No. 2010/0236019 A1, and Intl. Pub. No. WO2005/084511 A1.

In each case, the vacuum cleaner head disclosed, because of its size, structural design and/or other factors, is unable to be sufficiently accommodated within the confined or low-clearance areas commonly found under many kinds of appliances and furniture items. Attempts to design and construct a vacuum cleaner head that can more easily and effectively access and clean or otherwise remove dirt, debris or fluids from these areas have unfortunately met with failure as those devices are extremely limited in their ability to reach and maneuver sufficiently within confined or low-clearance areas to enable them to expand their coverage and maximize the full suction potential of the vacuum cleaner head. The generally long, flat and relatively thin vacuum heads or crevice tools shown as examples in the cited patent references above lack the ability to remain tight to the floor surface when in a vacuuming mode, which is an absolute necessity for achieving full suction capability are also incapable of vacuuming an acceptable amount of floor surface area.

The preference for the person operating the vacuum cleaner to remain mostly, if not entirely, in a generally upright posture or full standing position instead of having to bend or kneel down close to the floor to prevent the vacuum cleaner head from separating or lifting from the floor surface during the vacuuming process is absolutely paramount. In this regard, prior art vacuum cleaners embody structural flaws or deficiencies inherent at the juncture where the vacuum cleaner head and the hollow wand or suction tube used to direct the head are attached, which is at or very near the extreme back end of the vacuum head. This site of attachment naturally acts as a pivot point or fulcrum causing the vacuum cleaner head to lift off or separate from the floor surface whenever the person operating the vacuum cleaner attempts to lower the hollow hose wand or suction hose towards the floor to direct the vacuum cleaner head into, within and around confined or low-clearance areas under furniture, appliances and the like. This consequently produces the adverse result of neutralizing, weakening or possibly totally eliminating the suction capability of the vacuum cleaner head rendering it nearly ineffective, if not entirely useless, for its intended purpose.

Thus, mindful of the challenges unmet by prior art vacuum cleaners, more particularly those with vacuum cleaner heads that fail to achieve full suction as well as coverage capability otherwise expected of a vacuum cleaner head that is directed into a confined or low-clearance area, there is presently a need for an improved device that would resolve these inadequacies. Accordingly, the improved vacuum cleaner head of the present invention in combination with the components usually associated with conventional vacuum cleaners for suctioning dirt, assorted debris and fluids off a floor surface is provided to significantly improve the capability of the vacuum cleaner head for accessing and cleaning confined or low-clearance areas under certain kinds of furniture and appliances. Coupled with the capability to extend far into and maneuver more easily within those confined areas, the vacuum cleaner head of the present invention now makes it possible to expand the range of coverage and drastically improve the reliability, effectiveness and efficiency of the suctioning function of the vacuum cleaner head. There is also presently a need to achieve these objectives without requiring the person operating the vacuum cleaner to have to bend or kneel down close to the floor surface when extending the vacuum head into confined or low-clearance areas and attempting there to maximize the coverage potential of the head while concurrently holding the head tight to the floor surface. Instead, that person is now able to maintain a generally more comfortable and enduring relatively upright posture or full standing position when operating the vacuum cleaner and directing the vacuum head accordingly.

To achieve these objectives, the present invention includes, among other improvements and capabilities, a flat generally elongated hollow vacuum head and a flexible hose fitting set back a prescribed distance from the back end of the vacuum head where it is mounted and receives the flow of suctioned air carrying dirt, debris and fluids. The suctioned dirt, debris and fluids are then directed through a flexible hose fitting into the hose wand and eventually into the collection unit where the power source is normally also located.

Nothing exists in the prior art that teaches these advancements in the relevant technology, more specifically, an improved vacuum cleaner head that can more completely, reliably, effectively and efficiently access and clean confined or low-clearance areas, including, most importantly, vacuuming floor surfaces beneath certain items of furniture and kinds of appliances and behind, around and alongside the legs or wheels that support them, respectively, while the person operating the vacuum cleaner may remain in a generally upright posture or full standing position.

SUMMARY OF THE INVENTION

The present invention comprises a vacuum cleaner head used to access and clean confined or low-clearance areas such as, for example, the spaces under furniture and appliances in combination with an assemblage of suction-related components for vacuuming dirt, assorted debris and fluids off a floor surface into a dirt, debris and fluid collection unit. The vacuum cleaner head, which consists of a generally thin and flat elongated hollow member designed to reach maximum extension and floor surface coverage within confined or low-clearance areas, includes an elongated hollow member having a top member and a bottom member with the means to snap-fasten or otherwise join the top and bottom members together, a front end, a back end, a hollow chamber, and a suction head at the front end having a pair of laterally opposed wing-like members positioned transversely to the front end. Also included is a flexible hollow hose fitting set back a prescribed distance and disposed angularly, specifically at an acute angle, from near the back end of the elongated hollow member for slidably mounting the vacuum cleaner head to a hollow hose wand or suction tube having an upper end and a bottom end. The bottom end of the hollow hose wand or suction tube releasably attaches to the flexible hollow hose fitting, with the interior diameter of the flexible hollow hose fitting being slightly larger than the exterior diameter of the bottom end of the hollow hose wand or suction tube or are joined in some other mateable fashion. The upper end includes a user-operated means, for example, a handle, for pushing, pulling or otherwise compelling the vacuum cleaner head in all directions. The flexible hollow hose fitting is adapted to be bent in every direction, including downward, towards the floor surface. Sufficient downward pressure is exerted by the person operating the vacuum cleaner usually near or at the upper end of the hollow hose wand or suction tube for directing the vacuum cleaner head into confined or low-clearance areas located under furniture, appliances and the like.

The downward exerted pressure causes the vacuum cleaner head to remain pressed against the floor surface in constant sliding engagement with the floor to prevent the vacuum cleaner or suction head from lifting off or separating from the floor surface and neutralizing, weakening or even eliminating entirely the full suction capability of the vacuum cleaner head as a result. This, in turn, allows the person operating the vacuum cleaner to remain in a generally more comfortable and enduring relatively upright posture or even full standing position in the act of directing the vacuum head rather than requiring that person to bend or kneel down toward the floor surface, which until now had been the more common though much less comfortable alternative, to achieving the same objective.

The suction head further comprises an upper surface, a lower surface with an underside that includes one or more downward projecting tab members affixed to the underside. These projecting tab members have multiple objectives, the first of which is to maintain the position of the suction head in spaced-relation with the floor surface to prevent the underside of the suction head from engaging completely with the floor surface and, thus, neutralizing, weakening or even eliminating entirely the suctioning capability of the suction head. The second objective is to guide the flow of suctioned air carrying dirt, debris or fluid into and through the opening adjacent to the underside of the suction head and then into and through the hollow chamber, eventually through the flexible hollow hose fitting, the connected mated hollow wand or suction hose and ultimately into the collection unit.

Accordingly, it is an object of the present invention to provide a vacuum cleaner head for use in accessing and cleaning low-clearance or confined areas under furniture, appliances and the like for suctioning dirt, assorted debris and fluids off a floor surface.

Another object of the present invention is to provide a vacuum cleaner head for accessing and cleaning low-clearance or confined areas under furniture, appliances and the like more effectively, reliably and efficiently than the vacuum cleaners existing in the prior art are capable of performing.

Another object of the present invention is to provide a vacuum cleaner head for accessing and cleaning low-clearance or confined areas in combination with an assemblage of vacuum cleaner suction-related components to more effectively, reliably and efficiently suction dirt, assorted debris and fluids off a floor surface into an appropriate collection unit.

Another object of the present invention is to provide a vacuum cleaner head for accessing and cleaning low-clearance or confined areas under furniture, appliances and the like that includes an elongated hollow member having a front end, a back end, a hollow chamber, and a suction head for suctioning dirt, debris and fluids at the front end defined by a pair of laterally opposed wing-like members positioned transversely to the front end.

Another object of the present invention is to provide a vacuum cleaner head with an elongated hollow member having a flexible hollow hose fitting set back a prescribed distance and disposed angularly from the back end of the elongated hollow member.

Another object of the present invention is to provide a vacuum cleaner head with a flexible hollow hose fitting set back a prescribed distance from the back end of the elongated hollow member, which join to form an acute angle.

Another object of the present invention is to provide a vacuum cleaner head with a flexible hollow hose fitting to which a hollow hose wand or suction tube is slidably mounted.

Another object of the present invention is to provide a vacuum cleaner head with a flexible hollow hose fitting releasably attachable to the mated bottom end of a hollow hose wand or suction tube.

Another object of the present invention is to provide the upper end of the hollow hose wand or suction tube with a user operated means such as, for example, a conventional handle for pushing, pulling or otherwise compelling the vacuum cleaner head in all directions.

Another object of the present invention is to provide a vacuum cleaner head with a flexible hollow hose fitting capable of being bent or flexed downward toward the floor surface when a downward pressure is exerted by the person operating the vacuum cleaner upon the hollow hose wand or suction tube to enable the vacuum cleaner head to access and clean confined or low-clearance areas with the exerted pressure being imposed to ensure that the vacuum cleaner head remains in constant sliding engagement with the floor surface.

Another object of the present invention is to provide a flexible hollow hose fitting with the capability, when used in concert with the downward-directed hollow hose wand or suction tube, of preventing the vacuum cleaner head from separating or lifting from the floor surface while concurrently enabling the vacuum cleaner operator to maintain a generally more comfortable and enduring relatively upright posture or full standing position while vacuuming.

Another object of the present invention is to provide a vacuum cleaner head with an elongated hollow member that is generally thin and flat to enable access to low-clearance or confined areas under furniture, appliances and the like.

Another object of the present invention is to provide a flexible hollow hose fitting capable of being bent or flexed downward and in various other directions.

Another object of the present invention is to provide a flexible hollow hose fitting adapted for enabling the vacuum cleaner head to reach maximum extension and floor area coverage when vacuuming within the low-clearance or confined areas.

Another object of the present invention is to provide an elongated hollow member with a flexible hollow hose fitting which, when bent or flexed downward, prevents the vacuum cleaner head from lifting or separating from the floor surface while the vacuum cleaner operator maintains a generally more comfortable and enduring relatively upright posture or full standing position when vacuuming.

Another object of the present invention is to provide an elongated hollow member with a flexible hollow hose fitting which, when bent or flexed downward, prevents the vacuum cleaner head from rocking laterally off the floor surface while the vacuum cleaner operator maintains a generally more comfortable and enduring relatively upright posture or full standing position when vacuuming.

Another object of the present invention is to provide an elongated hollow member with a flexible hollow hose fitting which, when acting in concert with a properly positioned hollow hose wand or suction tube, enables the operational stability and full functional capability of the vacuum cleaner head.

Another object of the present invention is to provide one or more downward projecting tab members to prevent the underside of the suction head from engaging completely with the floor surface and, thus, neutralizing, weakening or eliminating entirely the suctioning capability of the suction head by maintaining the position of the underside of the suction head in spaced-relation with the floor surface.

Another object of the present invention is to provide a suction head with an opening formed adjacent to the underside of the suction head at the front end of the elongated hollow member for receiving the flow of suctioned air carrying dirt, debris or fluid into and through the hollow chamber of the elongated hollow member.

Another object of the present invention is to provide a vacuum cleaner head with an elongated hollow member wherein the downward-projecting tab members combine to guide the flow of suctioned air and the dirt, debris or fluid it carries through the suction head into and through the hollow chamber of the elongated hollow member.

Another object of the present invention is to provide a vacuum cleaner head with a flexible hollow hose fitting having an interior diameter larger than the exterior diameter of the bottom end of a hollow hose wand or suction tube to enable the two components to join in slideable releasable engagement.

Another object of the present invention is to provide a flexible hollow hose fitting capable of being replaced with another flexible hollow hose fitting appropriately sized to be mateable with a hollow hose wand or suction tube having a bottom end with a different diameter than the one it replaces.

Another object of the present invention is to provide a vacuum cleaner head with a flexible hollow hose fitting joined in mateable relation with the bottom end of a hollow hose wand or suction tube.

Another object of the present invention is to provide a vacuum cleaner head with an elongated hollow member comprised of a top member and a bottom member with the means to snap-fasten or otherwise join and secure the top and bottom members together.

Another object of the present invention is to provide a vacuum cleaner head that is cost effective to produce and easy to install and operate.

Other objects and advantages of the present invention in all of its embodiments will become apparent in the following specifications when considered in light of the attached drawings wherein the preferred and alternative embodiments of the present invention may be further illustrated.

DETAILED DESCRIPTION OF THE PREFERRED EMBODIMENT

Figure 1:
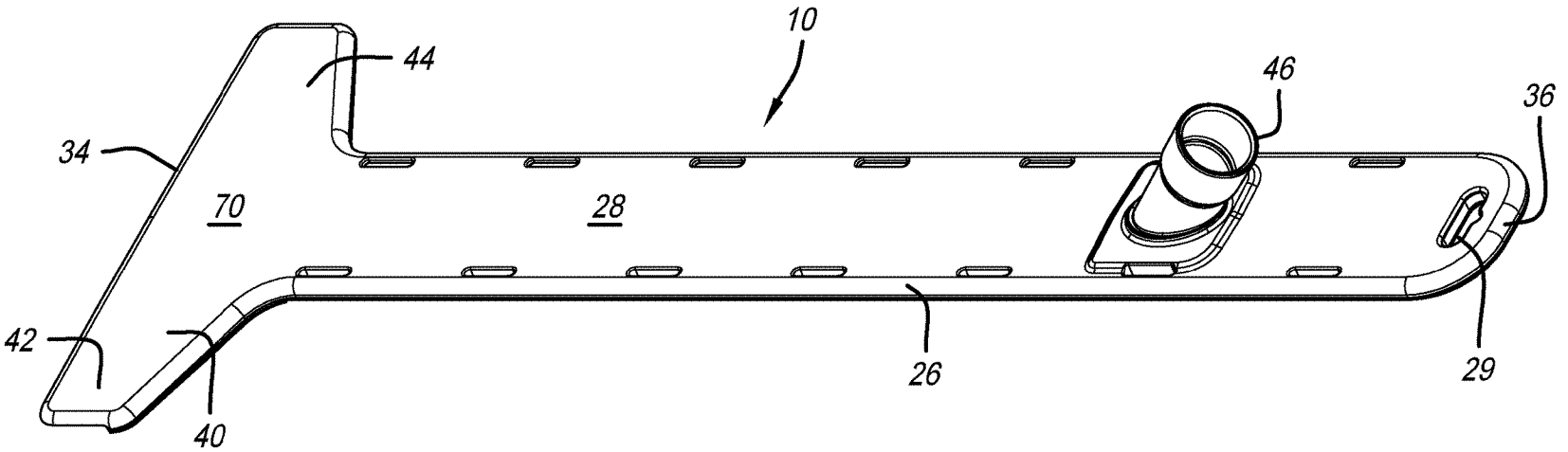
FIG. 1 is a perspective view of the top of the vacuum cleaner head according to one embodiment of the present invention.
Figure 2:
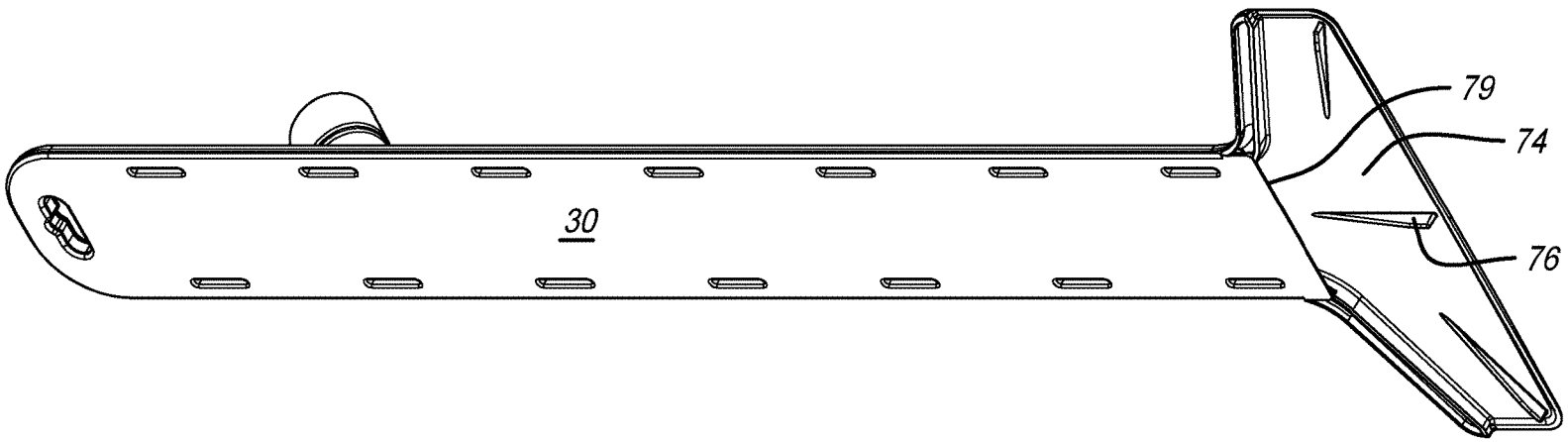
FIG. 2 is a perspective view of the bottom of the vacuum cleaner head according to one embodiment of the present invention.
Figure 3:
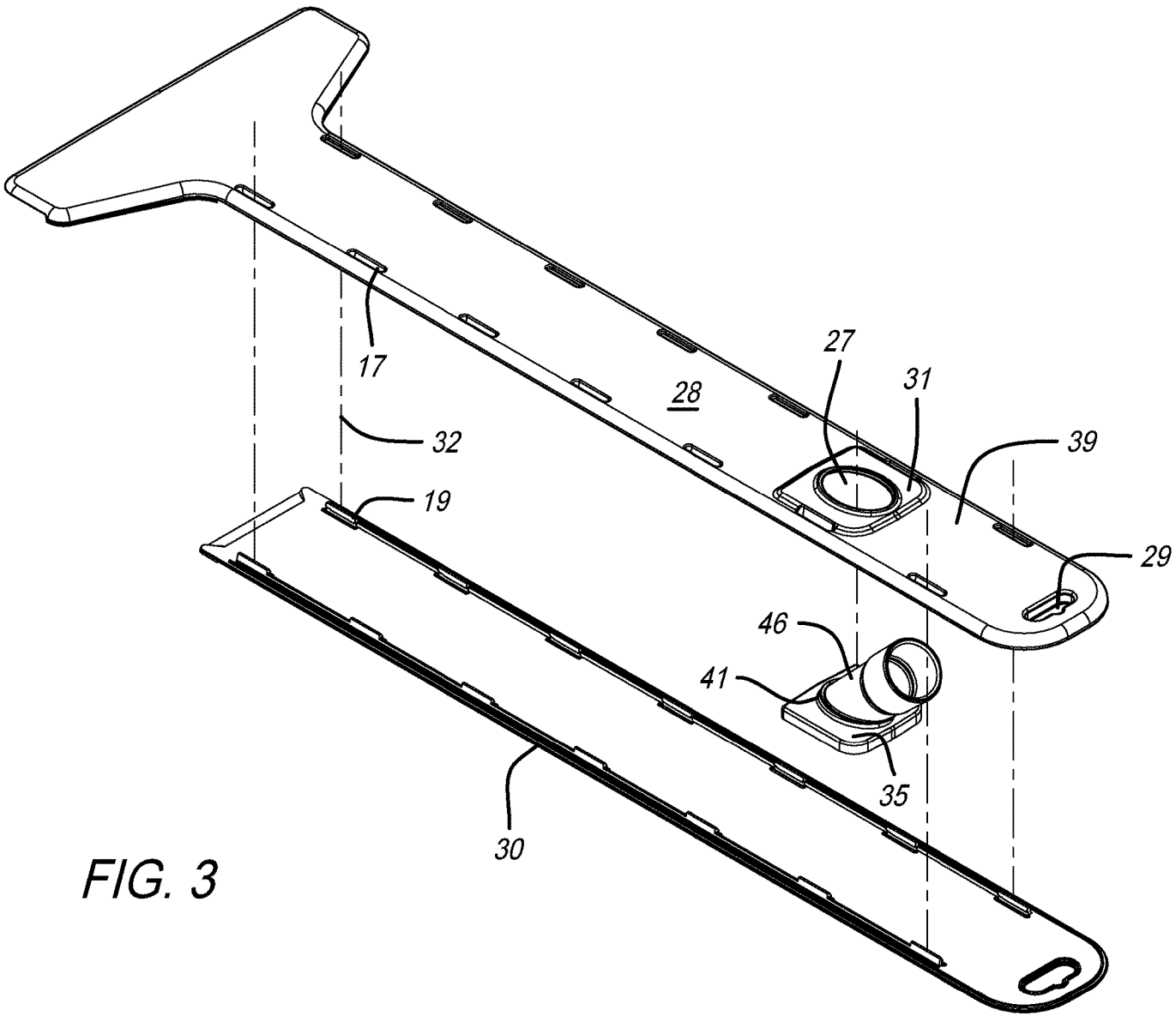
FIG. 3 is an exploded view of the vacuum cleaner head according to one embodiment of the present invention.
Figure 4:
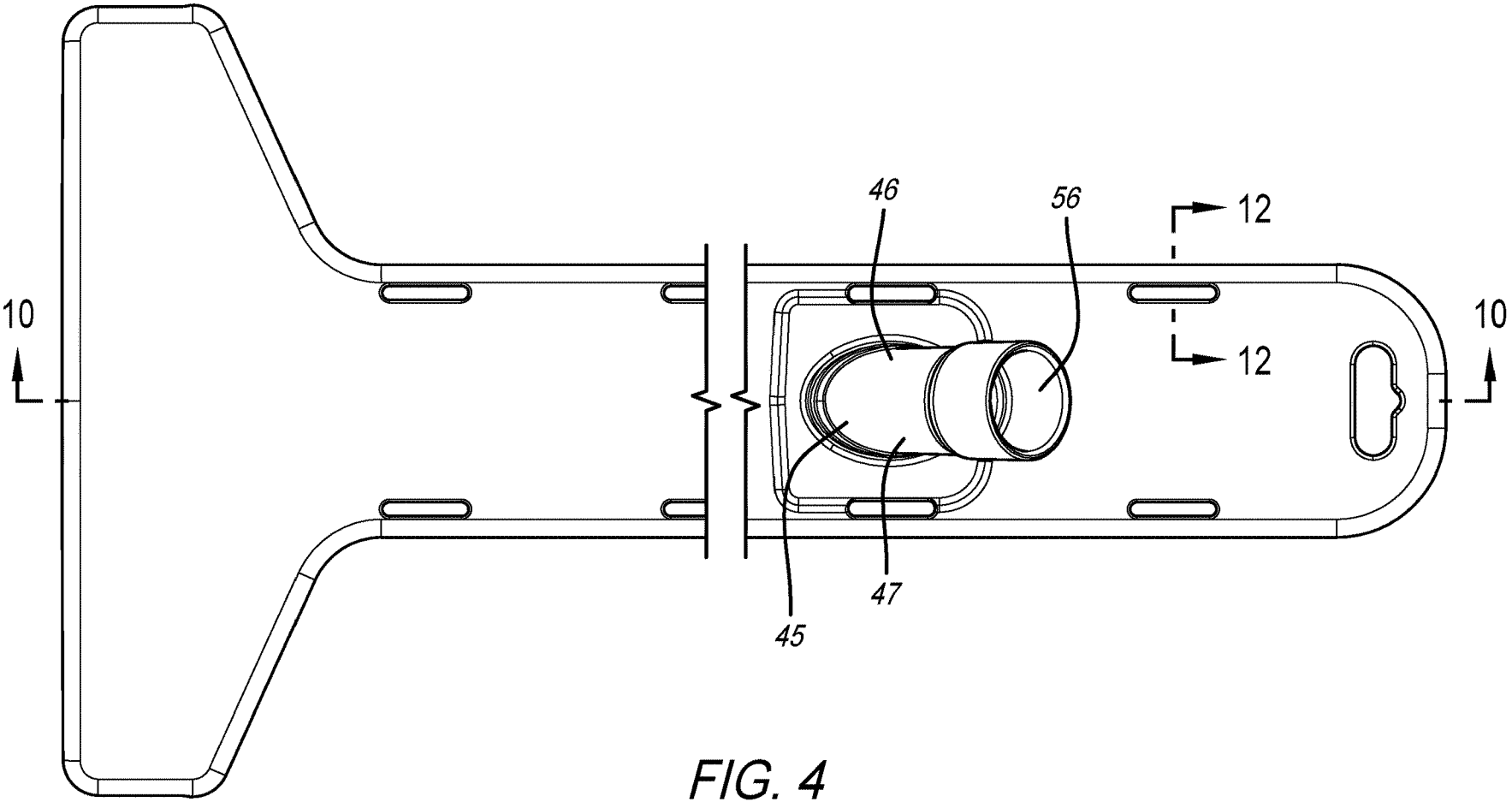
FIG. 4 is an enlarged perspective view of the top of the vacuum cleaner head according to one embodiment of the present invention.
Figure 5:
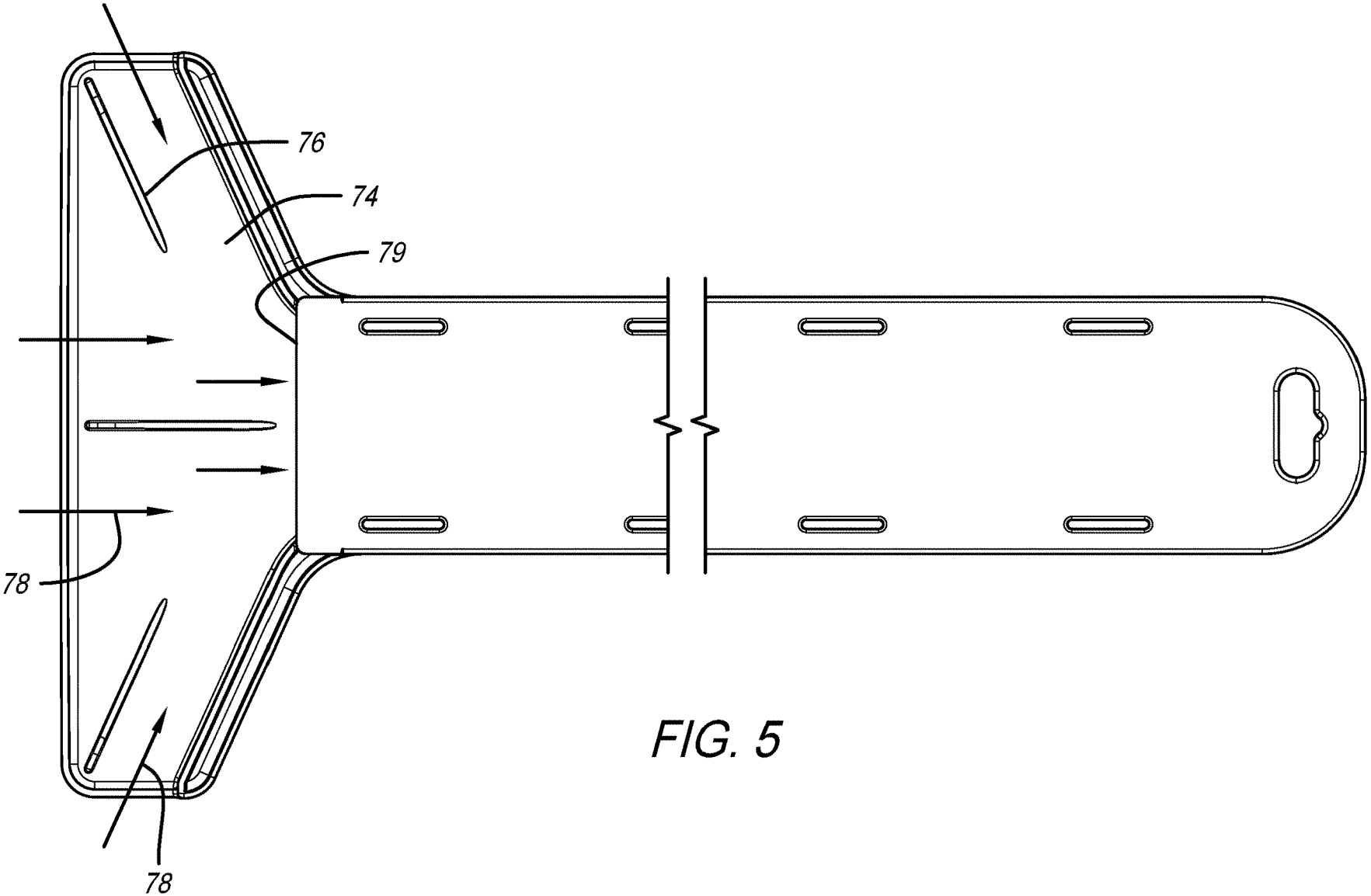
FIG. 5 is an enlarged perspective view of the bottom of the vacuum cleaner head according to one embodiment of the present invention.
Figure 6:
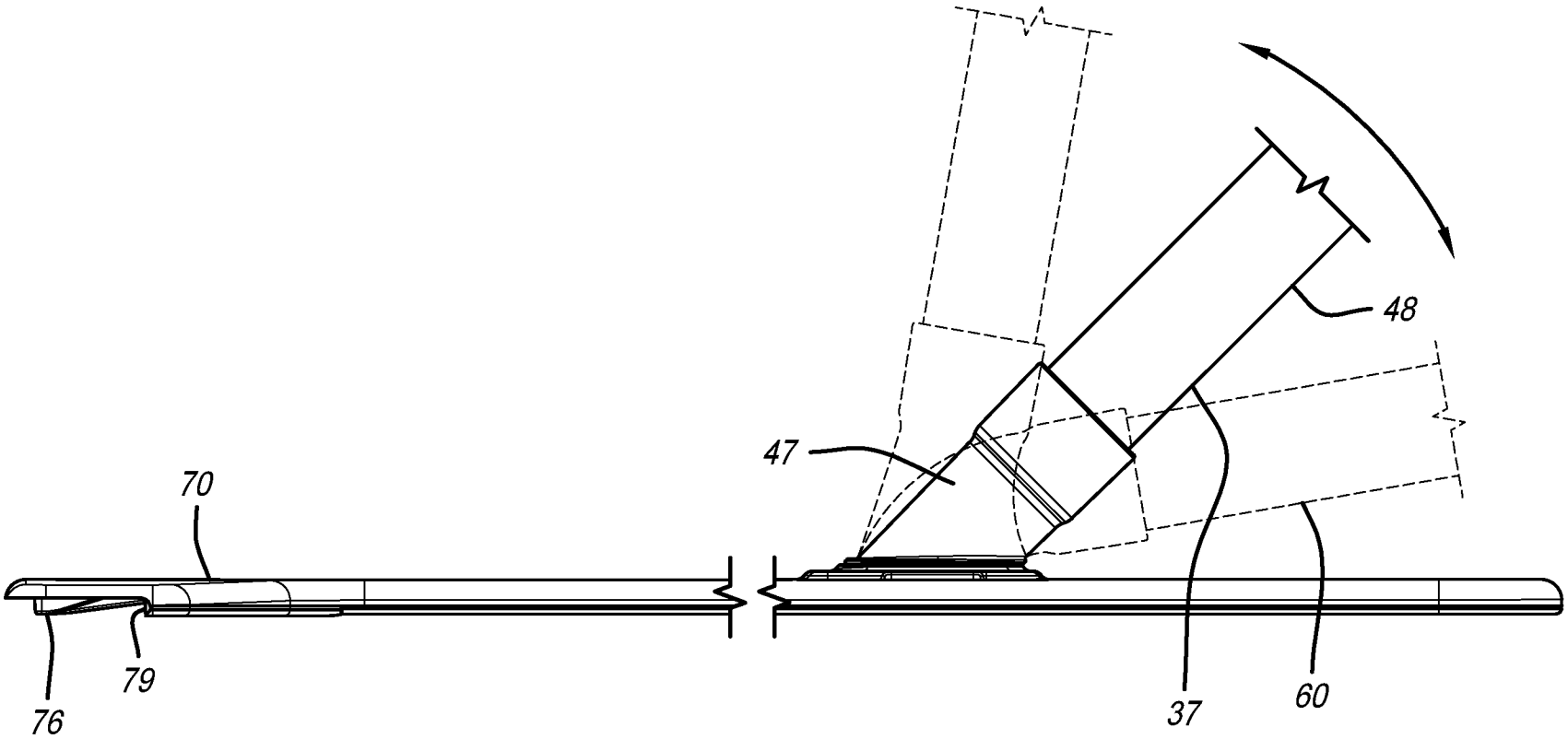
FIG. 6 is a side elevation view of the vacuum cleaner head according to one embodiment of the present invention showing the approximate range of flexibility of the flexible hollow hose fitting.
Figure 7:
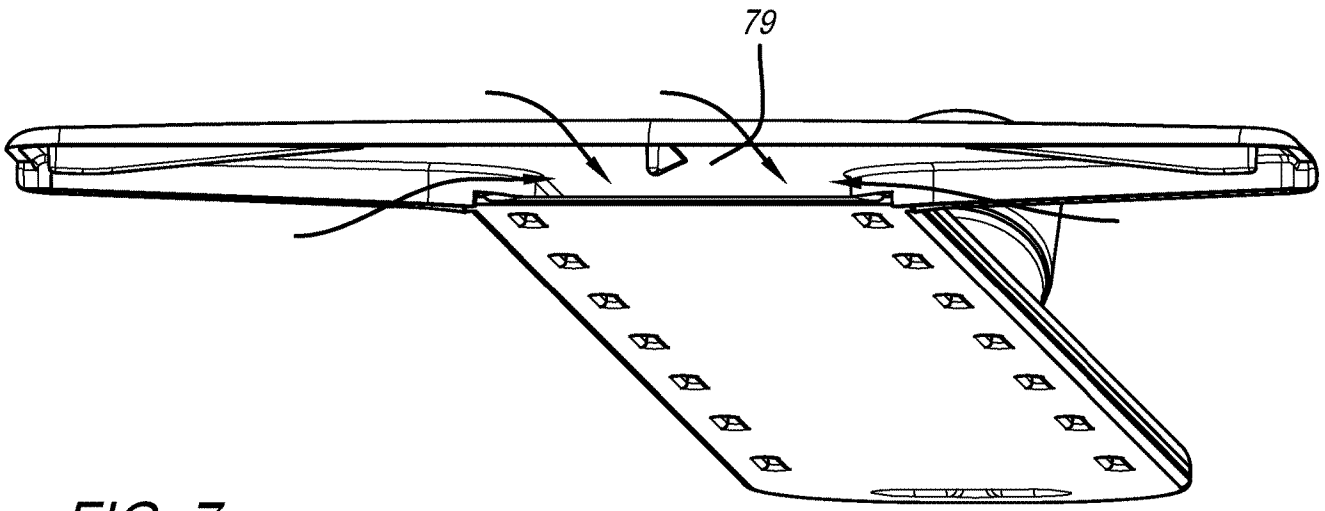
FIG. 7 is a front perspective view of the vacuum cleaner head according to one embodiment of the present invention showing the direction of the suctioned air flow entering the suction head at the front end.
Figure 8:
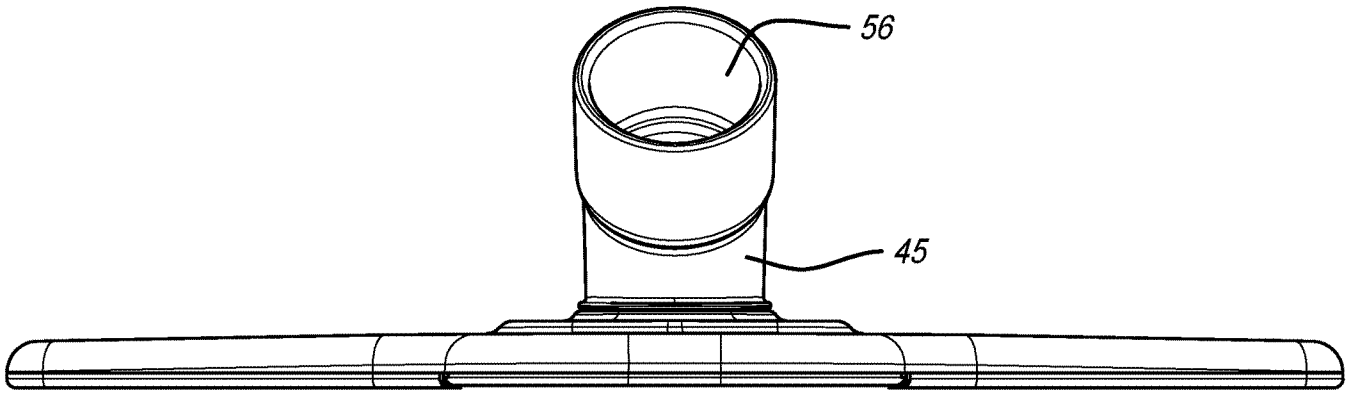
FIG. 8 is a rear perspective view of the vacuum cleaner head according to one embodiment of the present invention.
Figure 12:
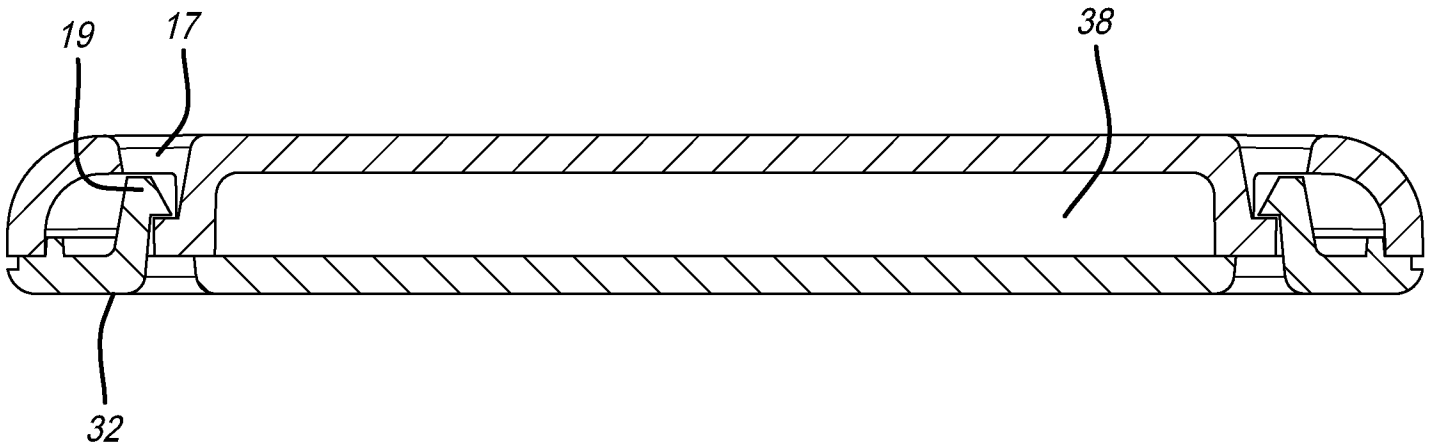
FIG. 12 is a cross-section perspective view of the elongated hollow member of the vacuum cleaner head according to one embodiment of the present invention shown along lines 12-12 of FIG. 4.
Figure 13:
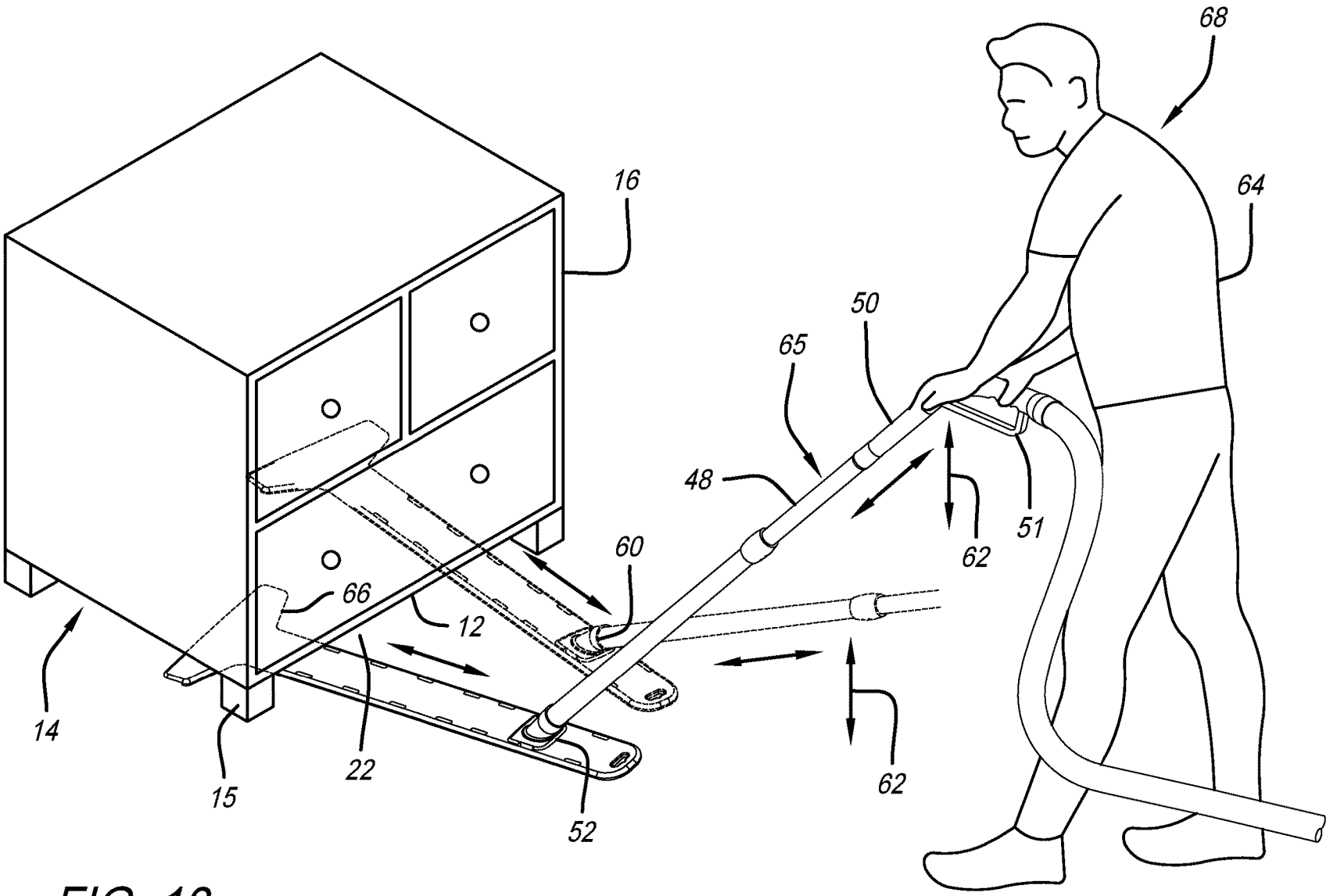
FIG. 13 is a perspective view of the vacuum cleaner head according to one embodiment of the present invention shown in operation by the user.

The present invention will be described in more detail with reference first to FIG. 1, a vacuum cleaner head 10 used to access and clean confined or low-clearance areas 12 such as, for example, the usually confined space 14 under furniture 16 and appliances (not shown) in combination with an assemblage of integrally related suction components 18 (see also FIG. 9) for suctioning dirt, assorted debris and fluids 20 off a floor surface 22 into a dirt, debris and fluid collection unit 24 located nearby a conventional suction source 25. Vacuum cleaner head 10 consists generally of a thin and flat elongated hollow member 26 designed to reach maximum extension and floor surface area coverage within confined or low-clearance areas 12 (see also FIGS. 9 and 13) of a size generally no greater than one-half inch in height and more effectively, efficiently and reliably vacuum those areas in the process. Using vacuum cleaner head 10 of the present invention also obviates the need for utilizing a special wand or crevice tool attachment (not shown) normally employed, though often not very effective, to access and clean difficult to reach areas under furniture, appliances and the like. Elongated hollow member 26 includes a top member 28 and a bottom member 30 with the means 32 to snap-fasten the top member 28 and bottom member 30 together, a front end 34, a back end 36, a hollow chamber 38, and a suction head 40 at the front end 34 having a pair of laterally opposed wing-like members 42,44 positioned transversely to the front end 34. The means 32 to snap-fasten top member 28 to bottom member 30 consists of mateable openings 17 and projections 19, which are joined with the use of an appropriate amount of pressure and then fastened with a snap action as shown in FIGS. 3 and 12 of the drawings. Top member 28 and bottom member 30 may also be attached using any other suitable means for that purpose including, without limitation, any kind of conventional screw, staples, rivets or adhesive.

Figure 14:
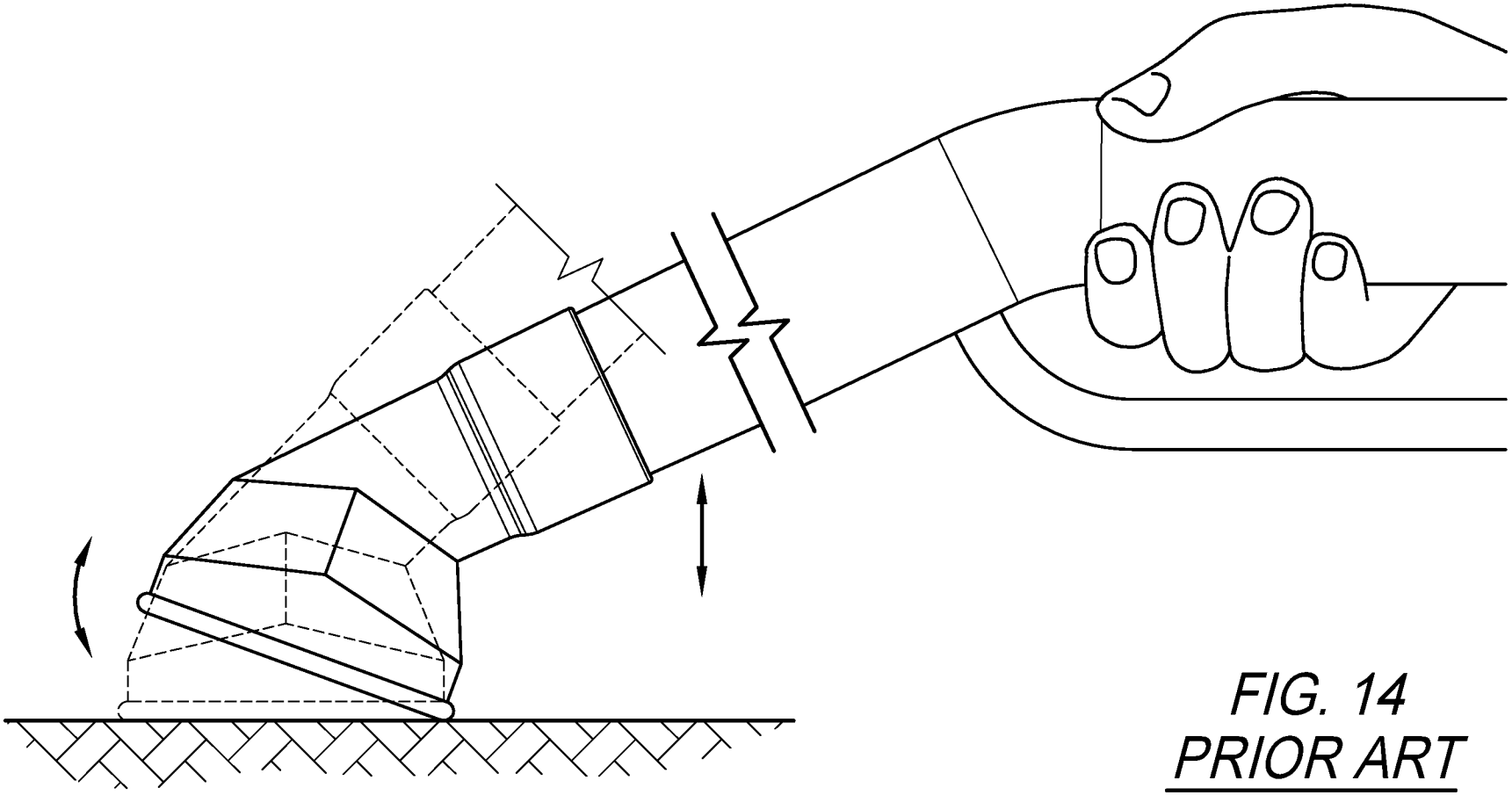
FIG. 14 PRIOR ART
FIG. 14 is a perspective side view of an example of a conventional vacuum cleaner head in the prior art.

Also provided is flexible hollow hose fitting 46, which includes a flexible tubular member 47, with arcuate sidewall 45, a back side 53 and a collar 35 integrally formed at the base 41 of flexible tubular member 47. Integrated within top member 28 of elongated hollow member 26 is a raised section 31 defining within a recessed area 33, which is designed to receive flexible tubular member 47 of flexible hollow hose fitting 46 through an opening 27. Recessed area 33 and collar member 35, which generally conform in shape and size, are brought together after which top member 28 and bottom member 30 are joined in snap-fashion or in some other suitable manner to secure the two components together and fix firmly in place flexible hollow hose fitting 46, more specifically collar 35. Flexible hollow hose fitting 46, though more specifically back side 53 of arcuate sidewall 45, is best located at a place 39 approximately three (3) inches from the back end 36 of elongated hollow member 26 though not so far forward as to create a fulcrum effect that would cause front end 34 to lift off floor surface 22 when hollow hose wand or suction tube 48 is directed toward floor surface 22 (see for example FIG. 14), which would otherwise neutralize, weaken or eliminate entirely the full functional capability of the suction head 40.

Another useful guide in properly positioning flexible hollow hose fitting 46 is to mount hose fitting 46 at a point forward of back end 36 so that the distance between back end 36 and the position where flexible hose fitting 46 is mounted is no greater than about fifteen (15) percent of the entire length of elongated hollow member 26. Means that may be suitable for securing flexible hollow hose fitting 46, including integrally formed collar 35, between top member 28 and bottom member 30, in addition to snap-fastening, as described, include, without limitation, any kind of conventional screw, adhesive or rivet. Vacuum cleaner head 10, more specifically opposed wing-like members 42,44, is constructed in a manner that enables vacuum cleaner head 10 to clean dirt, debris and fluids 20 located behind various appendages such as, for example, legs 15 of furniture 16. The wing shape and size of the opposed wing-like members 42, 44 (approximately eleven inches in width), though not an absolute requisite, make it possible for vacuum cleaner head 10 to cover a greater area or floor surface 22 and more efficiently suction a much larger amount of dirt, debris and fluids 20 in the process.

Flexible hollow hose fitting 46 is set back and disposed angularly, preferably at an acute angle 37, from back end 36 of elongated hollow member 26 for slidably engaging or otherwise joining with hollow hose wand or suction tube 48 having an upper end 50 and a bottom end 52. Bottom end 52 is releasably mounted to flexible hollow hose fitting 46 with the interior diameter 56 of flexible hollow hose fitting 46 being slightly larger than the exterior diameter 59 of bottom end 52 of hollow hose wand or suction tube 48. Hollow hose wand or suction tube 48 may be connected to flexible hollow hose fitting 46 in any other manner suitable for the intended purpose of joining the two together. Though preferably round in shape where the two are attached, flexible hollow hose fitting 46 and bottom end 52 of hollow hose wand of suction tube 48 may consist of any other suitable shape, such as, for example, rectangular or oval. The relative dimensions of these attachable components may also vary depending upon a variety of factors.

Figure 9:
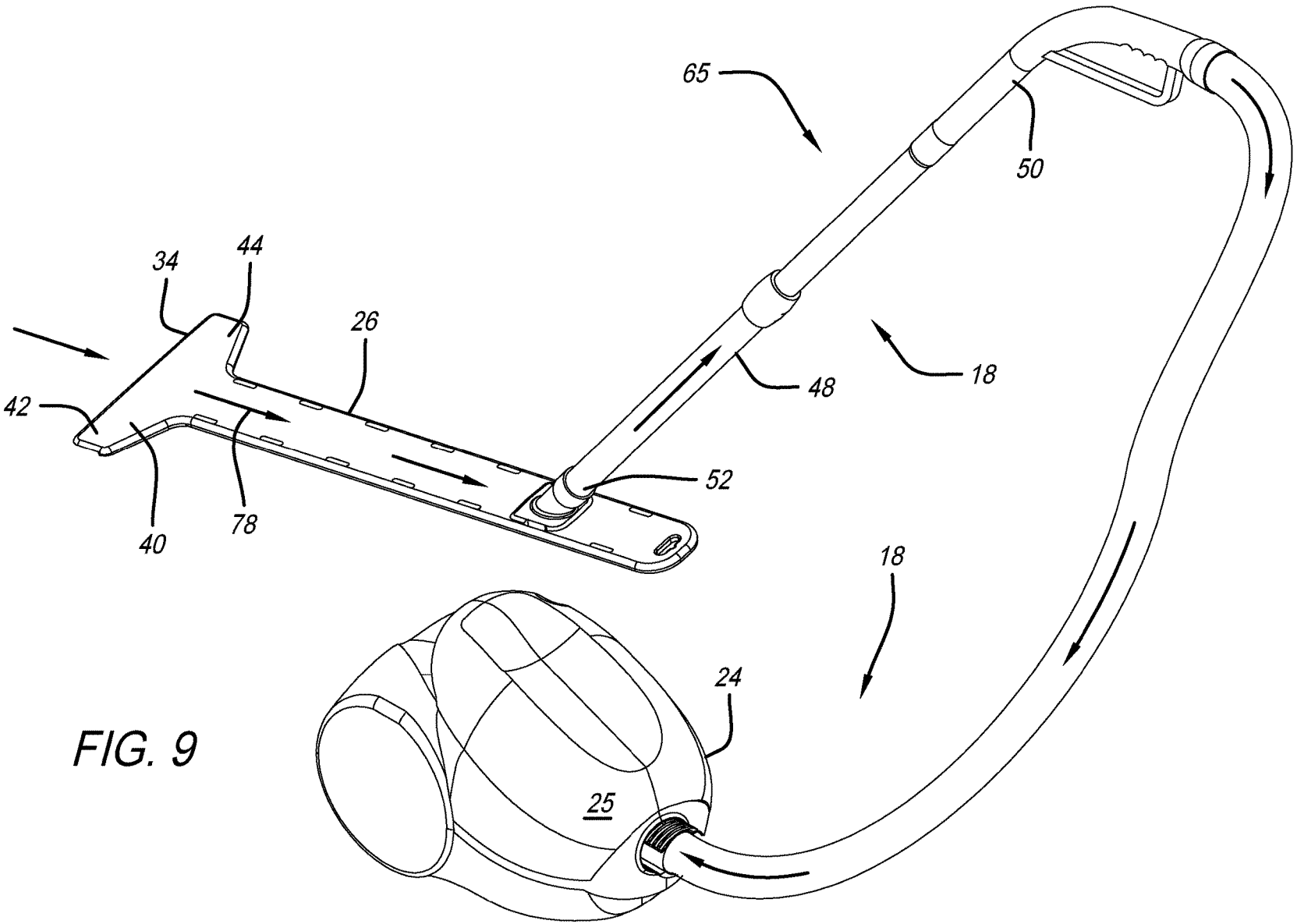
FIG. 9 is a view of the vacuum cleaner head according to one embodiment of the present invention shown in combination with other component parts of a vacuum cleaner.
Figure 10:
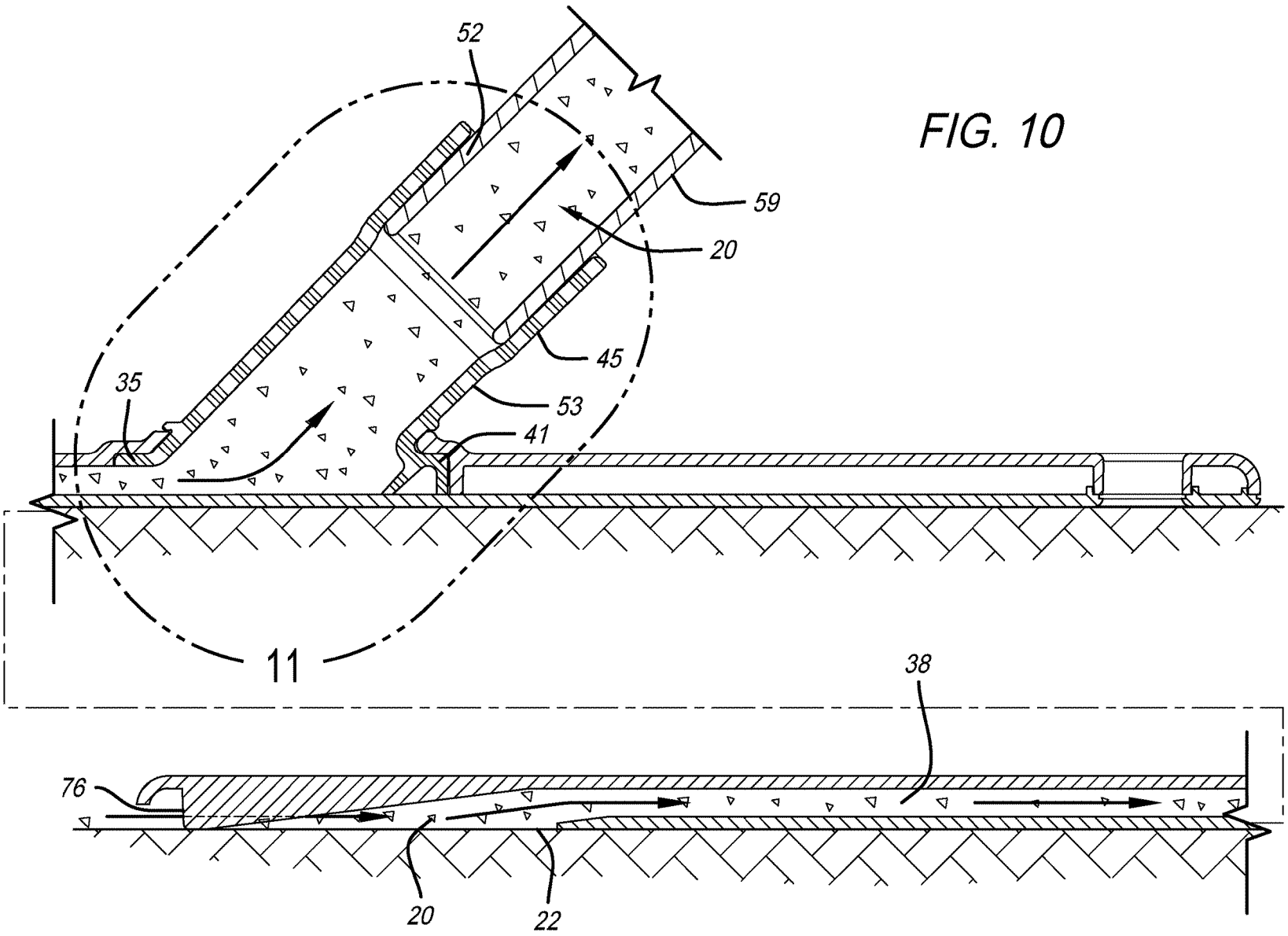
FIG. 10 is a cross-sectional view of the vacuum cleaner head according to one embodiment of the present invention shown along lines 10-10 of FIG. 4.
Figure 11:
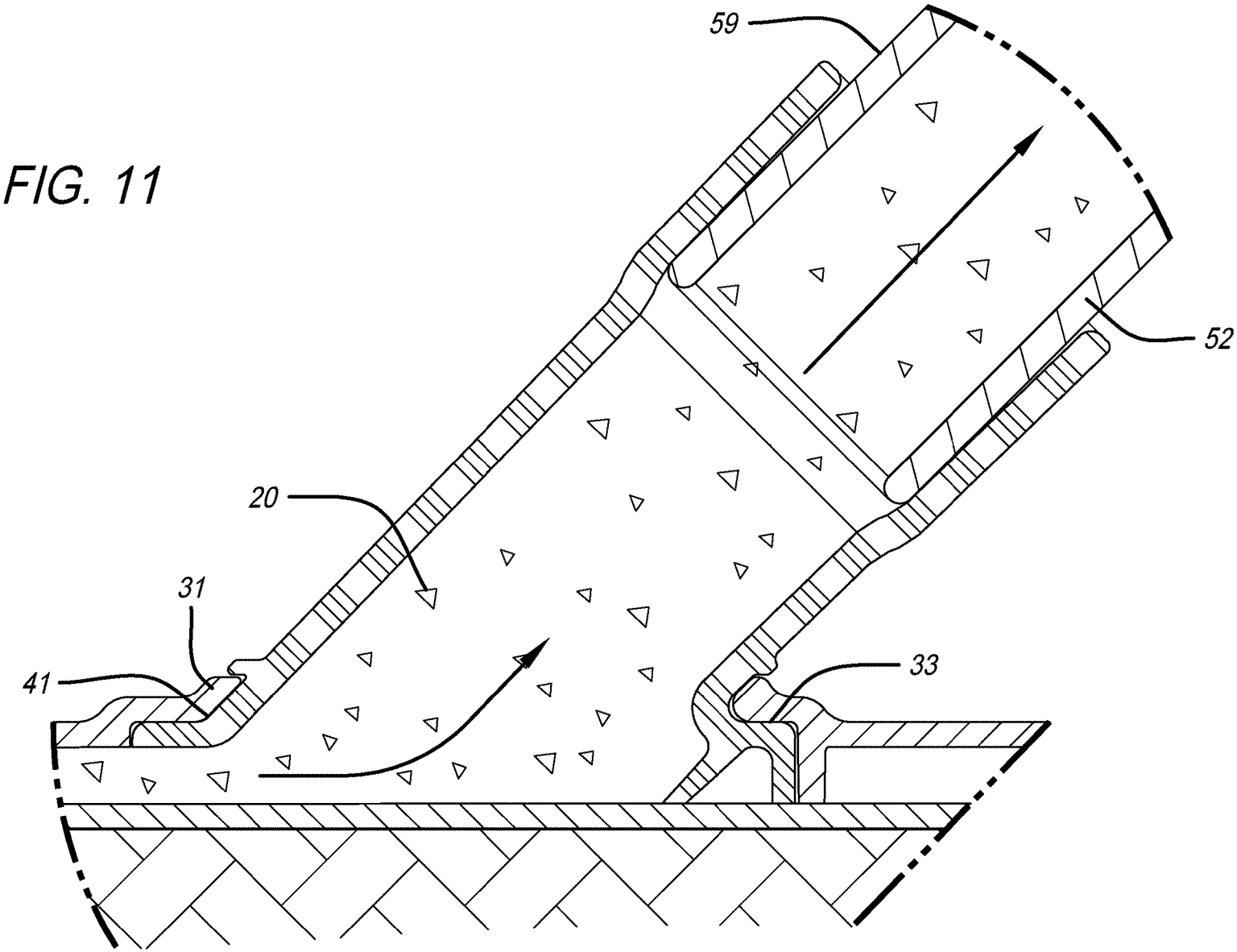
FIG. 11 is an enlarged cross-sectional view of the flexible hollow hose fitting according to one embodiment of the present invention shown along circular line 11 of FIG. 10.

Upper end 50 employs a user-operated means, including, for example, any type of conventional handle 51, for pushing and pulling vacuum cleaner head 10 in all directions. Materials used to construct the components, which include, without limitation, those comprising the assemblage of suction related components 18 all of which are joined together in cooperative relation with vacuum cleaner head 10 to constitute a conventional vacuum cleaner, such as shown in FIG. 9 include, without limitation, polymers such as polypropylene, polyvinylchloride and plastics, metal alloys (e.g., aluminum), natural rubber and any other suitable material that may be used to construct those components. Flexible hollow hose fitting 46 is adapted to be bent in a downward direction 60 toward floor surface 22 when a sufficient downward pressure 62 is exerted upon hollow hose wand or suction tube 48, including any point along wand or tube 48, though preferably nearby or at conventional handle 51, for the purpose of directing vacuum cleaner head 10 into confined or low-clearance or areas 12 to gain entry there for vacuuming and cleaning floor surface 22.

Downward-exerted pressure 62 forced upon hollow hose wand or suction tube 48, while attached to flexible hollow hose fitting 46, which is in turn mounted at acute angle 37 upon elongated hollow member 26, compels vacuum cleaner head 10 to remain tight against floor surface 22 in a sliding contact engagement 66 mode. This, in turn, prevents vacuum cleaner head 10 from separating from floor surface 22, which, if not undertaken in this manner, would otherwise neutralize, weaken or eliminate entirely the full functional capability of suction head 40. This also enables person 64 operating vacuum cleaner 65 to remain in a generally more comfortable and enduring relatively upright posture or full standing position 68 in the process rather than having to experience the alternative of a less comfortable and more strained posture, which would result, if the need arises, to bend or kneel down closer to floor surface 22 attempting to achieve the same objective. Suction head 40 comprises an upper member 70 with an underside 74 that includes one or more downwardly projecting tab members 76, which are affixed to underside 74. Projecting tab members 76 have multiple objectives, the first of which is to maintain the position of suction head 40, more specifically underside 74, in spaced-relation with floor surface 22 to prevent underside 74 of suction head 40 from engaging completely with floor surface 22 and, thus, neutralizing, weakening or eliminating entirely the suctioning capability of suction head 40. The second objective is for downward-projecting tab members 76 to funnel or coordinate the flow of suctioned air 78 into and through opening 79. From there, the flow of suctioned air 78 carrying dirt, debris or fluids is directed into and through hollow chamber 38. Elongated hollow member 26 also includes an opening 29 formed within back end 36 for use in hanging or storing vacuum cleaner head 10 on, for example, a nail or hook (not shown) when not in use.

Although the dimensions of elongated hollow member 26 may vary depending upon a number of factors, it is preferable, though not an absolute prerequisite, that elongated hollow member 26, including suction head 40, be no less than 30 inches in length, no greater than 4 inches in width, and no more than 0.375 inches in thickness. It is also preferable that opening 79 be approximately 0.0625 inches in height and span the width of elongated hollow member 26 to allow for the maximum amount of suctioned air 78 to flow through suction head 40 and continue throughout the rest of the vacuum system.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A vacuum cleaner head to clean confined or low clearance areas for suctioning dirt, debris or fluids off a floor surface and into a collection unit comprising:

an elongated top member (28) comprising a front end (34) having a suction head (40) with a pair of laterally opposed wing members (42, 44) and an underside (74) with one or more downwardly projecting tab members (76);

an elongated bottom member (30);

the elongated top member and the elongated bottom member connected to each other to form an elongated hollow member (26) having an intake opening (79) along the longitudinal axis facing the front end, and a distal back end (36);

the elongated top member further having a discharge opening (27) located between the front end and back end, distally from the front end;

a flexible tubular member (47) operably connected at the discharge opening at an acute angle, and having a distal end wherein the flexible tubular member can be releasably connected to a suction tube for operable connection to a collection unit.

2. The vacuum cleaner head of claim 1 in which the front end (34) is curved and the vertical distance between the curved end and the elongated bottom member (30) being less than the vertical distance between the underside (74) and the elongated bottom member (30).

3. The vacuum cleaner head of claim 1 in which the distance between distal back end (36) and the discharge opening is no greater than 15 percent of the entire length of elongated hollow member (26).

4. A vacuum cleaner head to clean confined or low clearance areas for suctioning dirt, debris or fluids off a floor surface and into a collection unit comprising:

an elongated top member (28) comprising a front end (34) having a suction head (40) with a pair of laterally opposed wing members (42, 44) and an underside (74);

an elongated bottom member (30);

the elongated top member and the elongated bottom member connected to each other to form an elongated hollow member (26) having an intake opening (79) along the longitudinal axis facing the front end, and a distal back end (36);

the elongated top member further having a discharge opening (27) located between the front end and back end, distally from the front end;

a flexible tubular member (47) operably connected at the discharge opening at an acute angle, and having a distal end wherein the flexible tubular member can be releasably connected to a suction tube for operable connection to a collection unit.

5. The vacuum cleaner head of claim 4 wherein the underside (74) further comprises one or more downwardly projecting tab members (76).

6. The vacuum cleaner head of claim 4 in which the distance between distal back end (36) and the discharge opening is no greater than 15 percent of the entire length of elongated hollow member (26).

7. The vacuum cleaner head of claim 5 in which the distance between distal back end (36) and the discharge opening is no greater than 15 percent of the entire length of elongated hollow member (26).

* * * * *